US005690172A

United States Patent [19]

Westra

[11] Patent Number: 5,690,172

[45] Date of Patent: Nov. 25, 1997

[54] SEAL-SUB PACKER AND A SETTING TOOL THEREFOR

[75] Inventor: Lubbert Westra, Diepholz-St. Huelfe, Germany

[73] Assignee: Alexander Oil Tools, Inc., Metairie, La.

[21] Appl. No.: 639,299

[22] Filed: Apr. 24, 1996

[51] Int. Cl.[6] ..... E21B 23/06

[52] U.S. Cl. ..... 166/123; 166/134; 166/139

[58] Field of Search ..... 166/118, 119, 166/123, 124, 125, 134, 138, 139, 181, 182, 195

[56] References Cited

U.S. PATENT DOCUMENTS

| | | | |
|---|---|---|---|
| Re. 31,933 | 7/1985 | Taylor et al. | 166/120 |
| 4,156,460 | 5/1979 | Crowe | 166/120 |
| 4,180,132 | 12/1979 | Young | 166/120 |
| 4,281,711 | 8/1981 | Braddick et al. | 166/118 |
| 4,438,811 | 3/1984 | Patel | 166/123 |
| 4,665,977 | 5/1987 | Mullins | 166/134 |
| 4,898,245 | 2/1990 | Braddick | 166/387 |
| 5,318,117 | 6/1994 | Echols, III et al. | 166/114 |

*Primary Examiner*—Frank Tsay
*Attorney, Agent, or Firm*—Keaty & Keaty

[57] ABSTRACT

The invention relates to a seal-sub packer assembly which is formed by a two-mandrel packer and a setting tool which positions the packer within the casing. A lower mandrel of the packer is provided with internal threads for engagement with the setting tool, thereby preventing premature setting of the packer. The exterior surface of the lower mandrel carries one or more sealing members which are compressed and forced to expand horizontally when the upper mandrel slides downwardly, shearing shear screws in response to a downward force acting on the setting tool. In an alternative embodiment, a liner hanger is secured to the lower mandrel, the liner hanger carrying an annular band with an inverted J-shaped slot through which a pin extends. When the body of the packer assembly is rotated in a predetermined direction, the guide pin extending through the J-slot resists premature setting of the packer.

19 Claims, 7 Drawing Sheets

SEAL-SUB PACKER AND A SETTING TOOL THEREFOR

BACKGROUND OF THE INVENTION

The present invention relates to a well drilling industry, and more particularly to a tool designed to assist in lowering various devices, for example packers, into a pipe-lined well.

It is conventional in a mineral mining industry to perform a directional drilling, that is a drilling which is not strictly vertical but varies from the vertical up to 90 degrees in order to reach a sulphur or other mineral deposit, i.e. oil and gas. The steep angle of the directional drilling creates a problem of setting various instruments within the wellbore if such instruments are adapted only for position in a more or less vertical well bore. The problem is associated with the design of the instruments, for example packers, which have a tendency to pre-set when they are pushed with a certain force down the well bore.

Conventional packers are provided with shear screws which will cause setting of the tool when a sufficient downward force is applied to the tool. In a directional well, the problem is particularly acute because the tools are not only provided with weighted collars and other means for increasing the mass of the tool but are also pushed down to compensate for the lack of gravity force acting on the tool that is lowered in a vertical well.

Premature setting of the packer causes considerable problems in the industry since the packer which has not set at a predetermined position within the well bore will have to be fished or drilled out resulting in loss of time and labor.

The present invention contemplates elimination of the drawbacks associated with the prior art and provision of a seal sub packer assembly suitable for use in high angle directional wells.

SUMMARY OF THE INVENTION

It is, therefore, an object of the present invention to provide a seal-sub packer and a setting tool therefor which will eliminate the problem of premature setting of an instrument lowered into a well bore.

It is another object of the present invention to provide a seal-sub packer which is adapted for sealing against an internal wall of the pipe with the use of expandable flexible members carried by the packer.

It is a further object of the present invention to provide a setting tool particularly adapted for setting packers in a well bore which deviates from a strictly vertical orientation.

It is still a further object of the present invention to provide a seal-sub packer assembly and a setting tool therefor which is easy to use and inexpensive to manufacture.

These and other objects of the present invention are achieved through a provision of a seal sub packer assembly which comprises a packer adapted for positioning inside a casing. The packer is comprised of a first, lower mandrel provided with exterior threads and at least one compressible expandable sealing member mounted on the exterior of the lower mandrel. A second, upper mandrel is mounted in circumferential relationship over an upper portion of the mandrel above the sealing members. The upper mandrel is secured to the lower mandrel by one or more shear screws which shear when the packer is being set in the casing.

An annular groove is formed in an inner wall of the upper mandrel, and a split ratchet ring is fitted into the groove, the ratchet ring threadably engaging an exterior wall of the lower mandrel.

An alternative embodiment of the assembly provides for the use of an integral liner hanger on the same lower mandrel in threadable engagement with the lower mandrel to allow positioning of the packer at a predetermined depth within the casing. The threads formed in the inner wall of the lower mandrel are adapted for engagement of a setting tool which allows positioning of the packer within the casing. The setting tool carries an enlarged diameter packer setting ring which contacts a top edge of the upper mandrel when the setting tool is moved with a sufficient force downwardly, forcing the mandrel to act on the sealing members, compressing the sealing members and extending them in a horizontal direction. The sealing members expand to contact the inner wall of the casing and seal the area above and below the sealing members.

The setting tool carries an annular band provided with an inverted J-shaped slot which receives a guiding pin therethrough. As long as the setting tool, and the packer attached thereto, is rotated in a direction that prevents movement of the pin normally positioned in a shorter part of the inverted "J" into a longer part of the slot, the packer will not set prematurely, thus affording a safety feature not heretofore known in the art.

BRIEF DESCRIPTION OF THE DRAWINGS

Reference will now be made to the drawings, wherein like parts are designated by like numerals, and wherein.

DETAIL DESCRIPTION OF THE PREFERRED EMBODIMENT

Figures 3, 6:
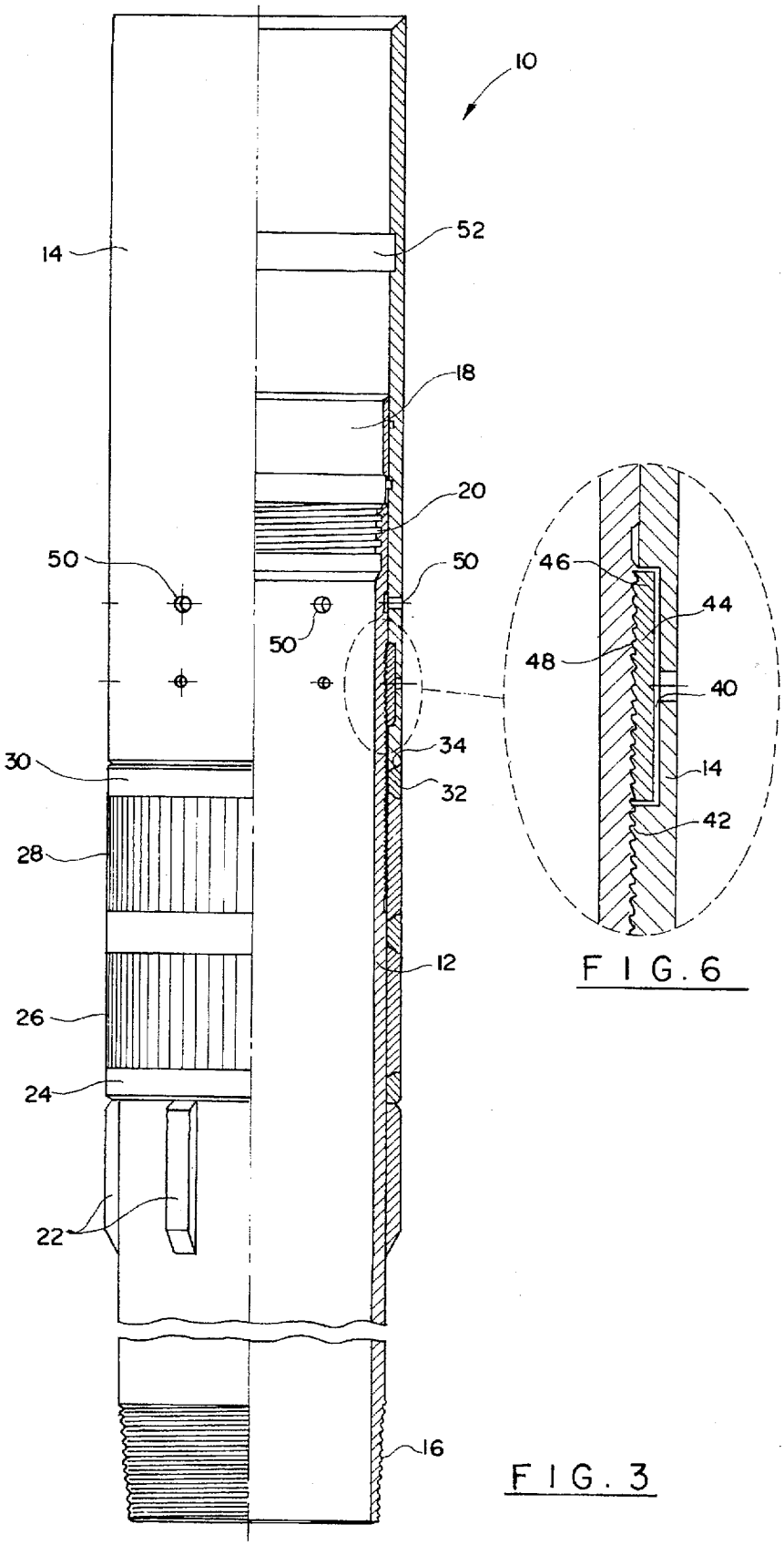
FIG. 3 is a perspective, partially cross-sectional view of a seal-sub packer assembly in accordance with the present invention.
FIG. 6 is a detailed view of a split ratchet ring mounted between the main mandrel and the upper mandrel of the seal-sub packer body.

Turning now to the drawings in more detail, and in particular to FIG. 3, a seal-sub packer assembly in accordance with the present invention is shown designated by numeral 10. The seal-sub packer, or seal-sub packer assembly comprises a main mandrel 12 and an upper mandrel 14. The main mandrel 12 has an externally threaded lower portion 16 and a top part 18 which is internally threaded, such as at 20, to allow engagement of the seal-sub packer with a setting tool, as will be described in more detail hereinafter.

A plurality of centering guides 22 are secured on the exterior surface of the main mandrel 12 for the purpose of centralizing the seal-sub packer and hold it in the center of the well bore. The guiding elements are formed in an elongated shape extending longitudinally along the exterior surface of the main mandrel 12 in a substantially parallel relationship to a longitudinal axis of the mandrel. The centralizing guides can be two, or more in number, spaced equidistantly about the exterior periphery of the main mandrel 12.

Mounted above the guides 22 is a lower spacer ring 24 which contacts a lower expandable seal 26. A second, upper expandable seal 28 is mounted in a spaced relationship with the first seal element 26 and is contacted in its upper portion by a second, top spacer ring 30. The seal elements 26 and 28 are formed from a resilient, compressible, flexible material, for example rubber, and have an ability to expand, widen compressed, to seal the area within a well bore above and below the seal-sub packer.

The second spacer ring 30 is provided with a top contact surface 32 which abuts a lowermost surface 34 of the upper mandrel 14. When a downward pressure is exerted on the mandrel 14, that is when it is pushed down, the mandrel will exert the downward pressure on the spacer ring 30, thereby compressing the seal elements 26 and 28 against the lower spacer ring 24. As a result, expansion of the seal elements 26 and 28 is achieved.

The upper mandrel 14 is mounted in a circumferential relationship about the upper part 18 of the main mandrel 12 and extends below the running nut receiver threads 20. An inner elongated groove 40 is formed on the inner wall 42 of the upper mandrel 14 and is designed to receive a split ratchet ring 44 therein (see FIG. 6). The ratchet ring 44 is provided with a threaded surface 46 extending along the inner wall of the ring substantially about its entire circumference. Threads 46 are designed to matchingly engage threaded surface 48 of the main mandrel 12, as can be better seen in FIG. 6. The ratchet ring 44 is split to allow for expansion and contraction of the ring. The split ratchet ring prevents releasing of the packer after the sealing elements have been compressed and have expanded.

A plurality of through openings 50 are formed in the body of the upper mandrel 14 above the recess 40. Each of the openings is internally threaded and is adapted to receive a shear screw therein. It is envisioned that the number of screws can vary from two to six, with each one taking up to about 3,000 lbs to shear out, thereby giving a maximum of 18,000 lbs of push when six shear screws are used. A second inner recess 52 is formed in the inner wall of the upper mandrel 14 to receive a tie back stinger which, however, does not form a part of the present application.

Figure 4:
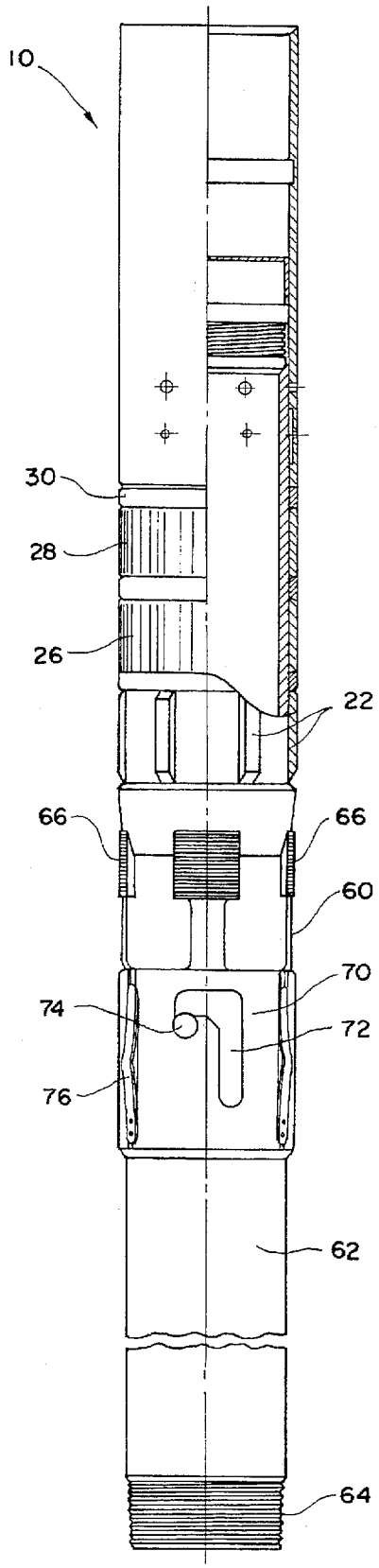
FIG. 4 is a perspective, partially cross-sectional view of a seal-sub packer in accordance with the present invention with a liner hanger.

Turning now to FIG. 4, the seal-sub packer 10 is shown assembled with a liner hanger 60 which is assembled below the centering guides 22 of the packer assembly 10. The liner hanger 60 comprises an elongated body 62 provided with exterior threads 64 in the lower portion thereof. Securely attached to the upper part of the liner hanger 62 are a plurality of equidistantly spaced fingers 66, each having a wedge shape to press against the outer pipe when the sub-seal assembly is positioned therein. Each of the wedge fingers 66 is wider in its lower part than in its upper part. As a result, if more weight is applied to the upper mandrel 12, the increased thickness of the wedge fingers 66 will provide more resistance. The wedge shaped members allow frictional engagement of the band with the inner wall of the casing and resists the downward force acting on the packer, the friction force increasing as the packer is forced downwardly.

Mounted below the fingers 66 is a band 70 formed with an inverted left hand J-slot 72, through which a pin 74 extends.

A plurality of guide springs 76 are secured to the band 70, in order to assist in retaining the band 70 and, thereby, position of the J-slot 72 while the pipe is turned and to allow release of the pin 74 out of the slot 72 to slack off the packer and set the slips of the hanger. The springs 76 will engage the wall of the casing to resist rotation. The guide springs 76 allow temporary retaining of the band 70 while the elongated body of the liner hanger 60 is rotated to release the pin 74 and allow it to slide within the longer portion of the J-slot.

It is envisioned that seal-sub packer of FIG. 3 will be particularly useful when setting the lower part of the casing string on the bottom of the well, while the packer with liner hanger shown in FIG. 4 will allow to set the packer at any desired location. As long as the packer assembly as shown in FIG. 4 is rotated counterclockwise, the seal-sub packer 10 will not prematurely set. Once the seal sub packer is delivered to the desired location, turning of the tool clockwise will release the pin from its set position in the shorter part of the J-slot, and move it within the body of the J-slot to allow disengagement from and setting of the packer at that time.

Figure 5:
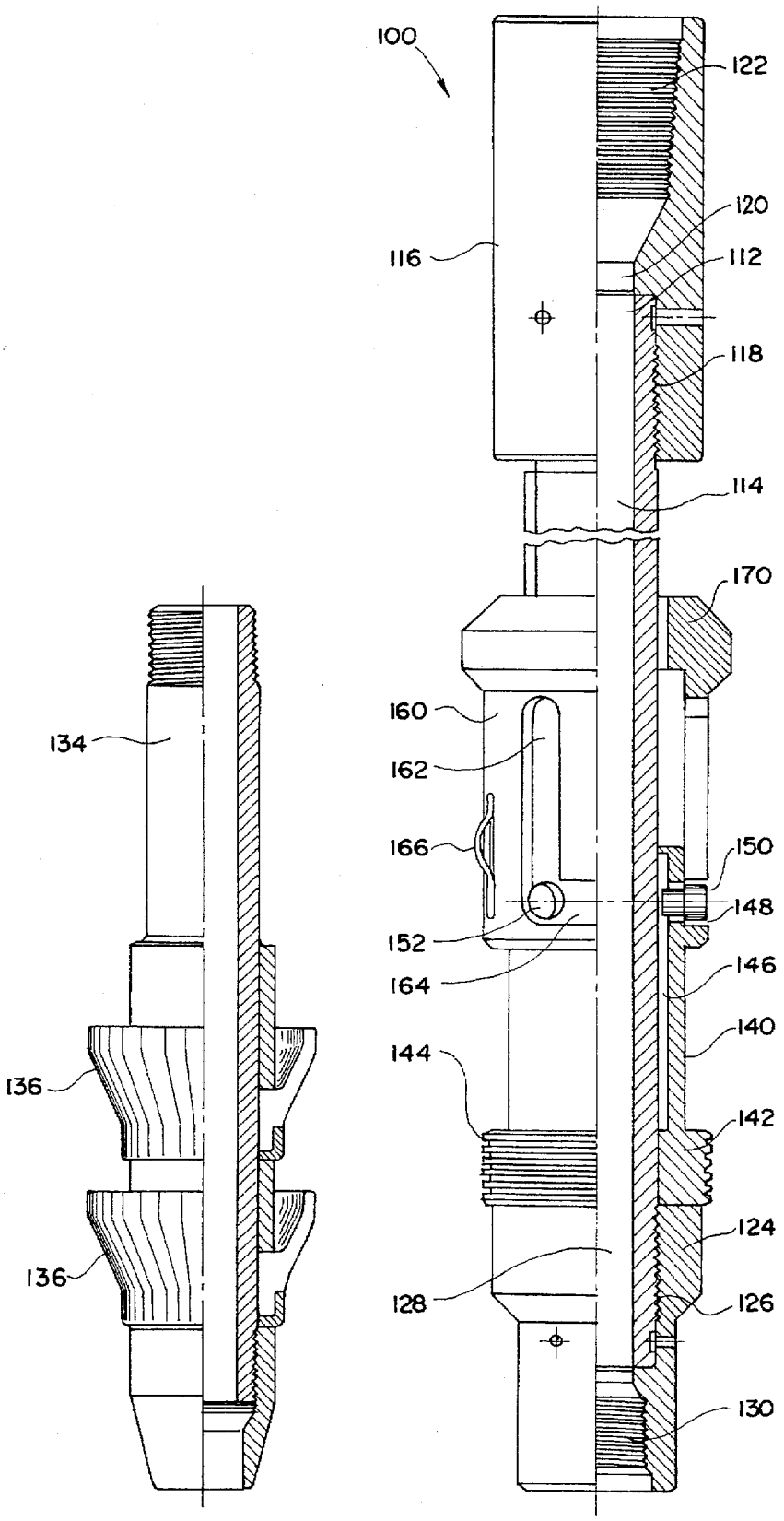
FIG. 5 is a perspective, partially cross-sectional view of a setting tool adapted for setting the packer shown in FIGS. 3 and 4.
Figure 7:
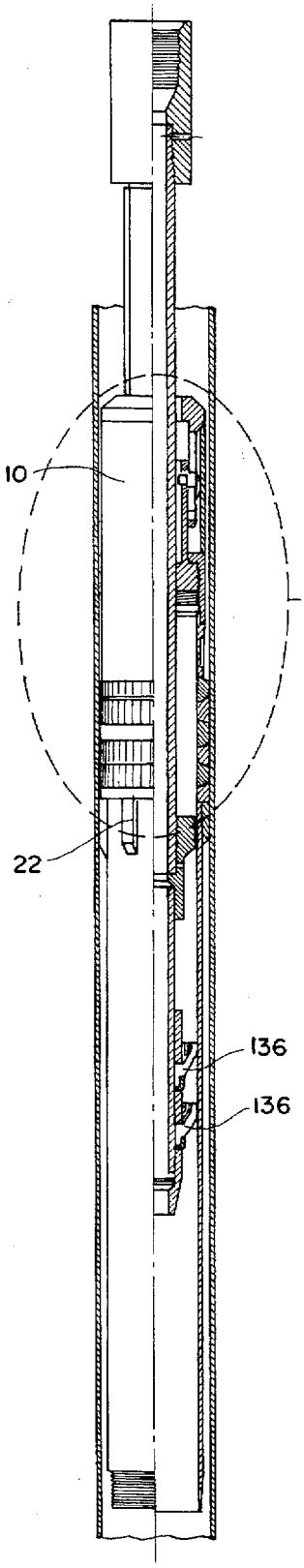
FIG. 7 is a perspective schematic view showing disengagement of the seal-sub packer from the setting tool immediately prior to setting of the packer.
Figure 8:
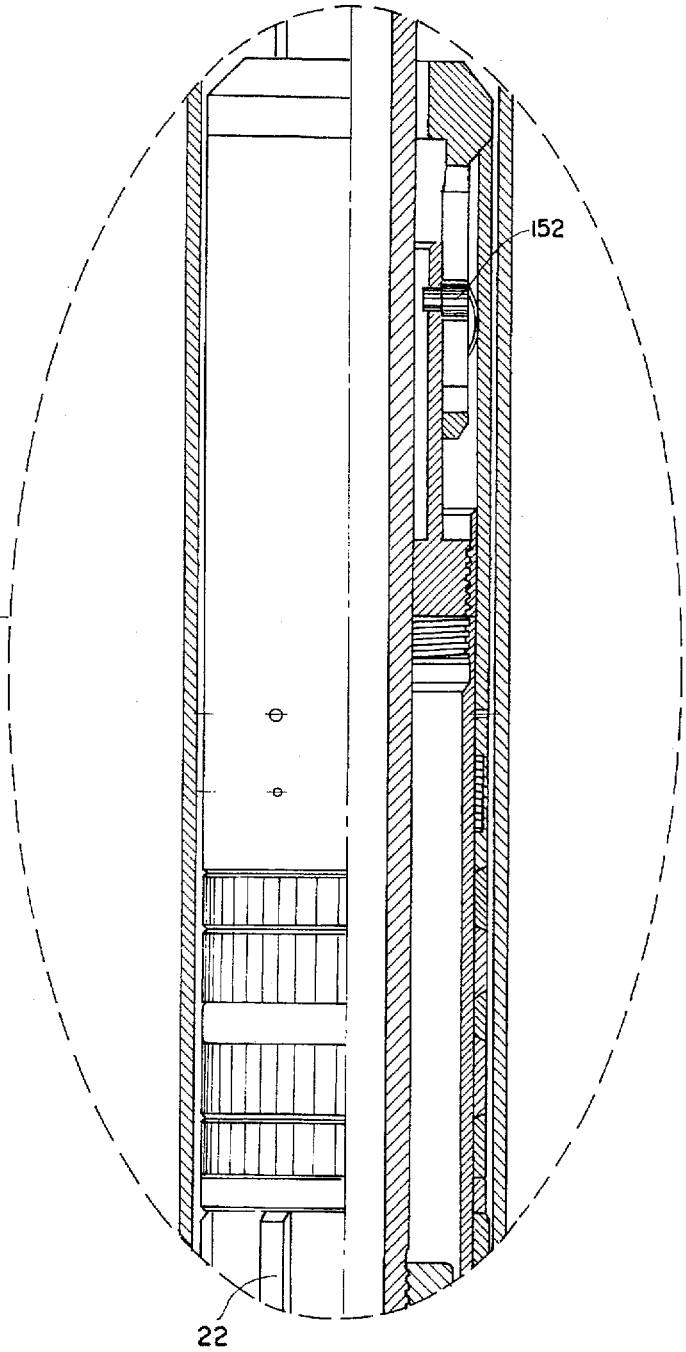
FIG. 8 is a detail view showing the area of engagement/disengagement of the setting tool and the seal-sub packer.
Figures 9, 10, 11:
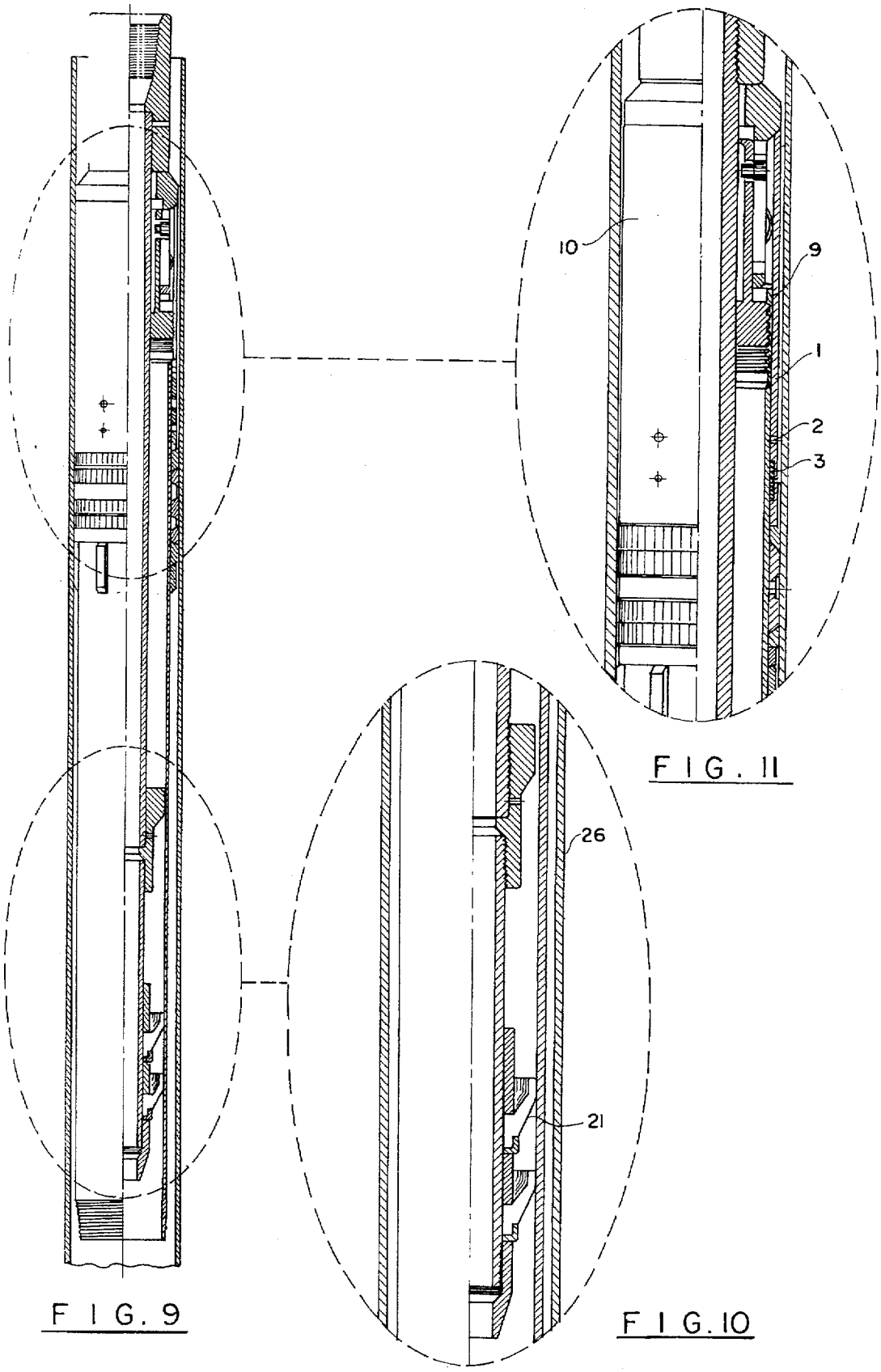
FIG. 9 is a perspective view showing position of the seal-sub packer during testing and setting of the packer.
FIG. 10 is a detail view showing the position of sealing cups of the setting tool.
FIG. 11 is a detail view of FIG. 9 illustrating the position of the seal-sub packer.
Figure 12:
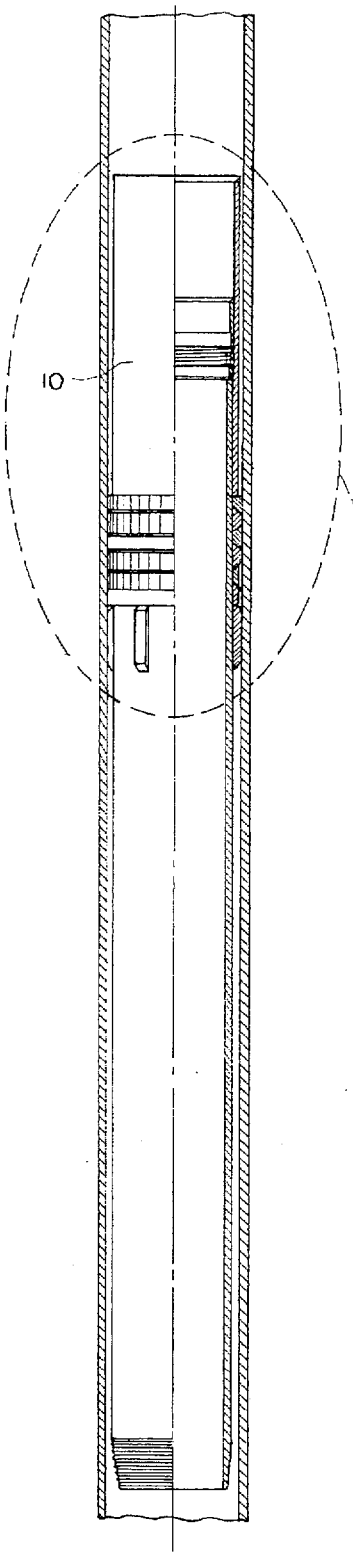
FIG. 12 is a schematic view illustrating position of the seal-sub packer in accordance with the present invention after the setting tool has been retrieved to the surface.
Figure 13:
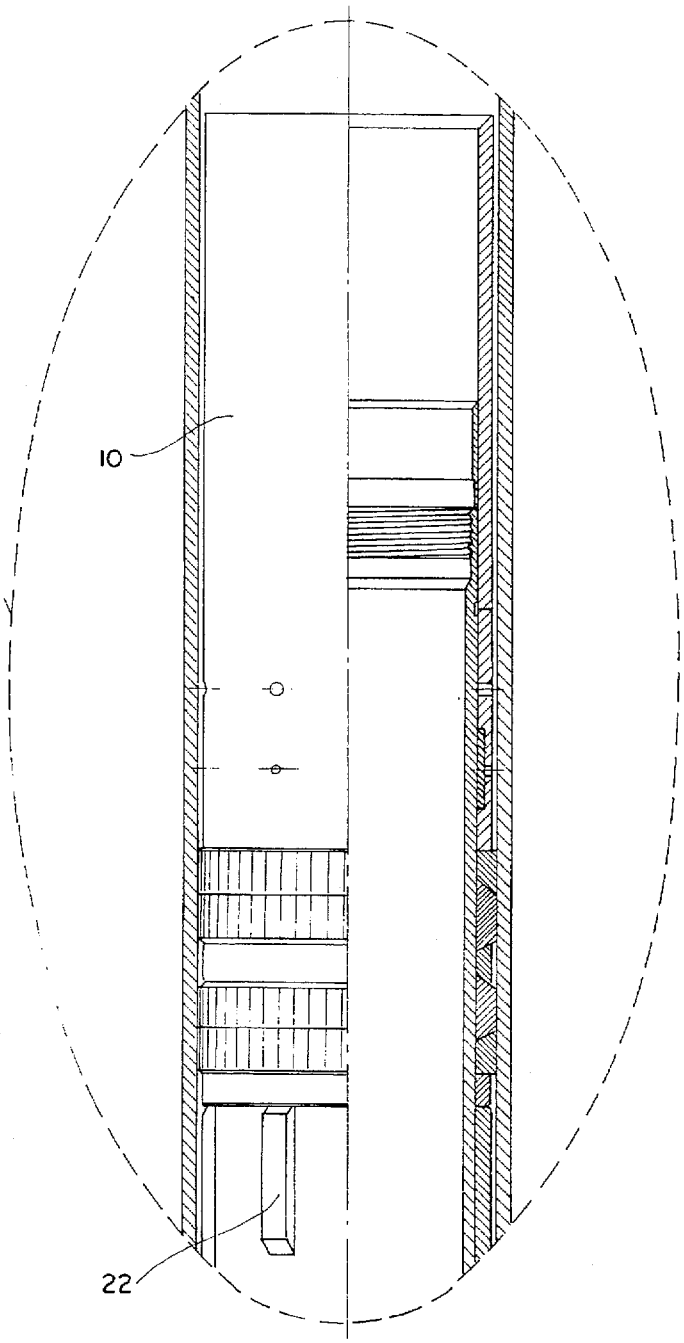
FIG. 13 is a detail view illustrating position of main seals of the sub-packer in the well bore.

Turning now to FIG. 5, a setting tool 100 for use with a seal-sub packer 10 of the present invention is shown. The setting tool 100 comprises an elongated mandrel 112 formed with a central opening 114 extending through substantially the entire length thereof. An upper sub 116 is threadably engaged by threads 118 to an upper part of the mandrel 112. The sub 116 is also formed with a central opening 120 which is coaxially aligned with the opening 114 of the mandrel 112. An enlarged diameter part of the opening 120 is provided with internal threads 122 which allow engagement of the setting tool 100 with a lowering instrument (not shown).

A lower sub 124 is threadably engaged with a lower part of the mandrel 112 by threads 126 and is similarly formed with a central opening 128 in a coaxial alignment of the opening 114 of the mandrel 112. An enlarged lowermost part of the opening 128 is provided with internal threads 130 adapted for engagement with external threads of the seal-sub packer assembly (see FIG. 5).

Mounted between the upper sub 116 and the lower sub 124 is a running nut member 140 which is mounted in a circumferential relationship about at least a part of the central mandrel 112. A lower part 142 of the running nut 140 has a diameter greater than the remainder of the running nut member 140 and is slightly greater than the diameter of the bottom sub 124. The portion 142 is provided with external threads 144 to allow engagement of the setting tool 100 with the main mandrel 12 by threadably engaging the running nut receiver 20 with the threads 144. As a result, the setting tool 100 can engage with a sub-seal packer assembly 10.

The internal shape of the portion 142 is that of a triangle. It corresponds to the outer shape of the mandrel 112, so that when the mandrel 112 is rotated, the nut member 140 is turned, yet the mandrel 112 is free to travel vertically up and down through the nut member 140.

It is of a particular benefit to the operation of the present invention that the entire weight of the seal-sub packer and liner that is run downhole is carried by the threads 144 on the setting tool engaged with the main mandrel. The prior art packers and setting tools, not having the advantage of the design in accordance with the present invention caused premature shearing of the screws, more particularly when the packer is positioned in a high angle well bore and an excessive amount of weight is applied on the packer.

In the present invention, it is only when the downward pressure is applied on the upper mandrel 12, that the shear screws 50 are sheared during setting of the packer assembly. This safety feature is made possible by the provision of the engaging running nut receiver threads 20 in the main, or lower mandrel 12, as opposed to the upper mandrel 14. When a downward force is applied to the setting tool, the force is transmitted, through the threads 144 and 20 to the lower mandrel 12, allowing to deliver a much greater force to move the tool down. The downward force applied to the mandrel 12 will not cause expansion of the sealing elements 26 and 28.

The running nut member 140 is provided with a central opening 146, the diameter of which is greater than the exterior surface of the triangularly-shaped mandrel 112, such that an annular space if formed between the exterior of the mandrel 112 and the interior wall of the running nut member 140. The central opening of the portion 142 of the running nut member 140 is triangular to conform to the external shape of the mandrel 112. A plurality of openings 148 are formed through the body of the running nut member 140 adjacent an upper part thereof. The openings extend through the wall of the running nut member 140 in a transverse relationship to a longitudinal axis of the running nut member 140 and are adapted to receive matchingly sized and shaped guide pins 150 therethrough.

The head 152 of each of the guide pins 150 has a diameter greater than the diameter of the openings 148, thereby preventing disengagement of the guide pins 150 from the running nut member 140. Mounted between the upper sub 116 and the running nut member 140 is a packer setting collar 160 which is formed with at least one and, preferably, a plurality of J-slots 162.

The slots 162 extend through the body of the collar 160 and partially overlap a portion of the running nut member 140, such that the guide pins 150 appear at the intersection of a vertical and a horizontal part 164 of the slots 162 when the setting tool 100 is prepared for assembly to the seal sub packer.

As long as the operator is careful to rotate the setting tool 100 to the left, that is counterclockwise, similar to the direction for rotating the seal-sub packer with hanger liner, and not rotate the setting tool 100 to the right, the packer will not prematurely set when lowered down the hole. A drag spring 166 is provided on the exterior of the collar 160 to slow down rotation of the collar 160.

Figure 1:
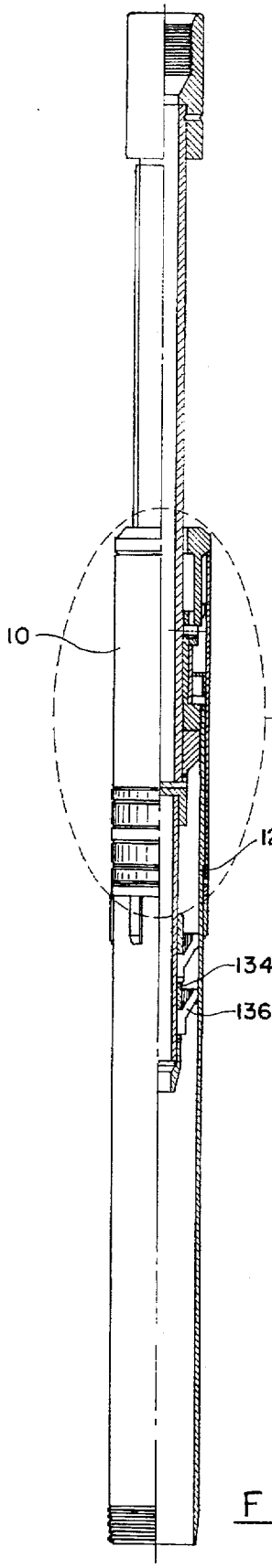
FIG. 1 is a schematic view of a seal-sub packer assembly and a seal-sub setting tool in a running position.

A sealing sub 134 is provided as part of the setting tool 100, the sealing sub 134 being adapted for engagement with the main mandrel 12, as shown in FIG. 1. The sealing sub 134 is provided with one or more sealing cups 136 which are formed from a flexible resilient material, for example rubber, mounted in a circumferential relationship about the sub 134. The external diameter of the sealing cups 136 is preferably slightly larger than the internal diameter of the seal-sub packer within which the setting tool and the seal sub 134 are positioned during running of the packer in the well bore.

Figure 2:
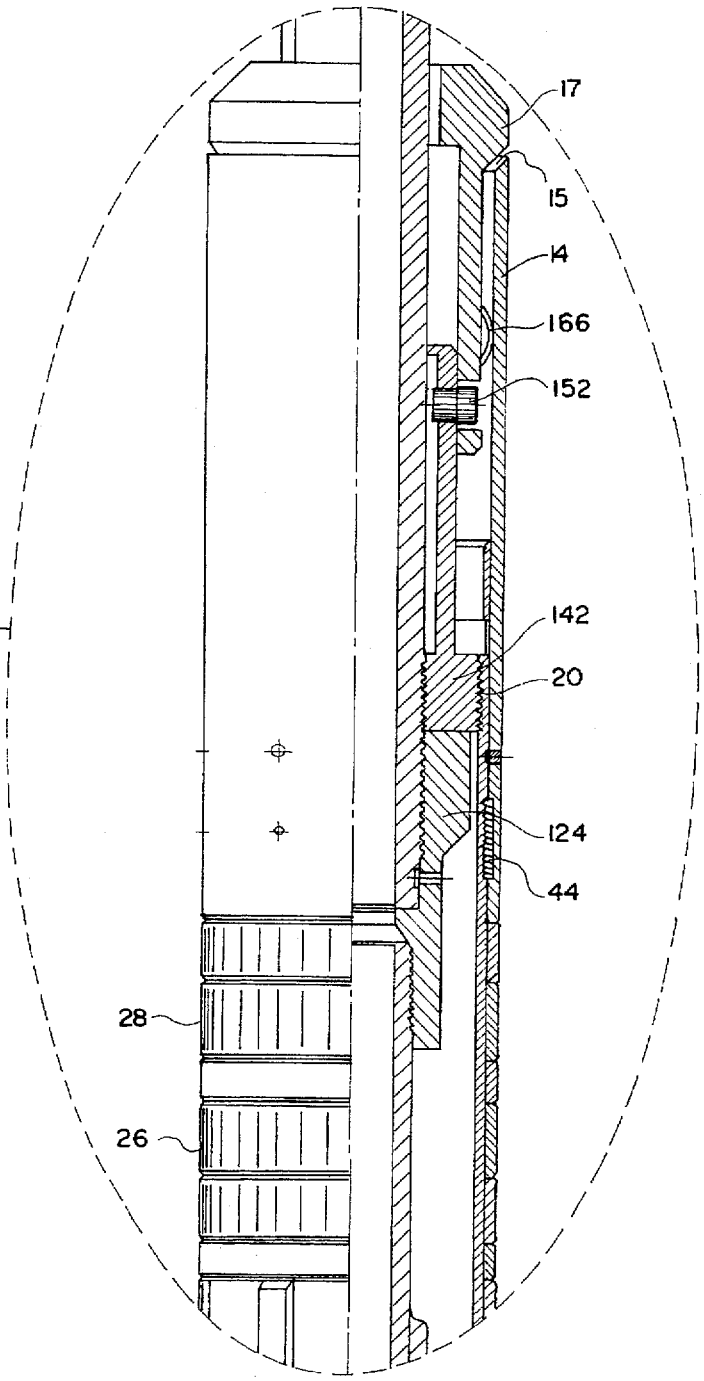
FIG. 2 is a detail, partially cross-sectional view showing the manner of engagement between the seal-sub packer and the setting tool.

Turning now to FIGS. 1 and 2, the assembly and running sequence of the seal sub packer will be described. The packer setting ring, 170 on the setting tool 100 is turned to the fight to hold the pin 152 in the lower "J" position. With a packer 10 top held up at an angle, the setting tool 100 is inserted into the packer 10 until the running nut 140 is down in a position to make up in the sub-seal packer assembly 10. The setting tool 100 is then rotated counterclockwise a predetermined number of turns, for example 6, until carrying threads 144 are engaged with the threaded portion 20 of the packer assembly 10. Then the seal-sub packer and the setting tool together can be lowered into the hole, being careful not to turn the assembly in a clockwise direction, that is to the fight.

FIG. 2 illustrates in detail the relative position between the threads on the setting tool 100 and the threads 20 of the main mandrel 12. The packer setting ring 170 cannot contact the top edge 15 of the upper mandrel 14 and transmits the downward force thereto, as long as the guide pins 152 are engaged in the horizontal part of the J-slots 162.

Setting and testing of the packer can be accomplished by slacking off 6–12 inches. The tool is rotated to the right, that is clockwise, until the setting tool 100 has made at least six full turns inside the sub-seal packer assembly 10. As a result, the threads 144 have disengaged and the pins 152 are in the vertical part of the "J" slots 162, which allows the packer setting ring to be pushed down and contact the top edge 15 of the upper mandrel 14 and transmit the downward force thereto. Then additional weight is slacked off until a "jar" is observed, indicating that the shear screws have sheared and the seal elements 26 and 28 are engaged, setting the packer. The packer can be tested by closing blowout preventors and pressuring up on the casing annulus to test the seals 26 and 28 of the packer assembly 10.

The seal-sub packer with the liner hanger of FIG. 4 can be made and run in a similar manner. The packer setting ring 170 on the setting tool is turned to the right to hold it in the lower "J" position. With the packer hanger top held up at an angle, the setting tool 100 is inserted to the packer 10 while it is in its most extended position, until the running nut 140 is down in a position to make up with the threads 20 in the packer assembly. The setting tool 100 is then rotated six full turns to the left, that is counterclockwise, until carrying threads are snugged up. The band 70 with the inverted J-slot 72 is set in the upper position, with the pin extending through the slot as shown in FIG. 4, so that the hanger will not set going down the hole.

In order to set and cement the seal-sub packer, the packer with the liner hanger is moved to a desired setting depth. The drill pipe is then picked up for a discrete length to extend the setting tool mandrel while turning the drill pipe to the left, since it takes less than ¼ of a left turn of the hanger to move the sub-seal packer with a liner hanger into a setting position. Then the liner weight is slacked off to hang the seal-sub packer with the liner hanger. While the setting tool 100 is in a closed position it is suggested that the seal-sub packer be checked to make sure that the hanger is set.

The procedure is then followed by circulating and conditioning the hole, if necessary, and cementing in a conventional manner. When the mixing and the pumping of the cement is completed, the setting tool can be released from the packer hanger by slacking off to close the setting tool 100 to its releasing position and then rotating the drill pipe six full turns to the right. Then enough weight is slacked off of the seal-sub packer liner hanger to set the packer.

The safety mechanism afforded by provision of the design in accordance with the present invention minimizes, or even completely eliminates, the occurrence of premature setting of a packer, thereby saving time and labor costs of a directional well.

Many changes and modifications can be made in the design of the present invention without departing from the spirit thereof. I, therefore, pray that my rights to the present invention be limited only by the scope of the appended claims.

I claim:

1. A seal-sub packer assembly, comprising:

a packer adapted for positioning inside of a casing, said packer comprising a first lower mandrel provided with interior threads and at least one compressible expandable sealing member mounted on an exterior surface of the lower mandrel, a second, upper mandrel mounted in circumferential relationship over at least a portion of said lower mandrel above said at least one sealing member and releasably secured thereto by at least one shear screw; and a setting tool engageable with said interior threads of said lower mandrel for setting the packer inside the casing; said setting tool comprising an enlarged diameter ring which contacts a top edge of said upper mandrel, and whereby application of a predetermined downward force on said setting tool moves said upper mandrel downwardly shearing said at least one shear screw and causing vertical compression and horizontal expansion of said at least one sealing member in contact with an interior wall of the casing.

2. The assembly of claim 1, wherein said lower mandrel is provided with means for centralizing position of said packer within said casing.

3. The assembly of claim 2, wherein said means for centralizing position comprises a plurality of elongated members extending outwardly from an exterior surface of said lower mandrel below said at least one sealing member.

4. The assembly of claim 1, wherein said upper mandrel has an inner annular groove, and a split ratchet ring is fitted in said groove, said ring threadably engaging in exterior wall of said lower mandrel to prevent said at least one sealing member from moving from its expanded position.

5. The assembly of claim 1, wherein said packer further comprises a liner hanger engageable with said lower mandrel below said at lest on sealing member.

6. The assembly of claim 5, wherein said liner hanger comprises an elongated cylindrical body, and an annular band is mounted in a limited sliding relationship over said body, said band being provided with an inverted J-shaped slot, and wherein a pin fixedly attached to said body extends through said slot, so as to prevent premature setting of said liner hanger while the packer is being lowered to a predetermined depth within said casing.

7. The assembly of claim 6, wherein said band carries a plurality of guide springs to allow a temporary retaining of the band while the body of the liner hanger is rotated to release said pin and allow said pin to slide within said slot.

8. The assembly of claim 6, wherein a plurality of wedge-shaped friction members are secured on an exterior surface of said body above said band, said friction members engaging the inner wall of said casing with a friction force which increases as the packer is forced downwardly.

9. A seal-sub packer assembly, comprising:

a packer adapted for positioning inside a casing, the packer comprising a first lower mandrel provided with interior threads and at least one compressible expandable sealing member mounted on an exterior of the lower mandrel, a second upper mandrel mounted in circumferential relationship over at least a portion of said lower mandrel above said at least one sealing member and releasably secured thereto by at least one shear screw;

a liner hanger engageable with said lower mandrel below said at least one sealing member, said liner hanger comprising an elongated cylindrical body and an annular band mounted in a limited sliding relationship over said body, said band being provided with an inverted J-shaped slot, said slot being adapted to receive a pin fixedly attached to and extending outwardly from said body through said slot; and a setting tool engageable with said interior threads of said lower mandrel for setting the packer inside the casing, said setting tool comprising an enlarged diameter ring which contacts a top edge of said upper mandrel, and whereby application of a predetermined downward force on said setting tool moves said upper mandrel downwardly, shearing said at least one shear screw and causing vertical compression and horizontal expansion of said at least one sealing member in with contact an interior wall of said casing.

10. The assembly of claim 9, wherein said upper mandrel is provided with an inner annular groove, and wherein a split ratchet ring is fitted in said groove, said ring threadably engaging an exterior wall of said lower mandrel preventing said at least one sealing member from moving from its expanded position.

11. The assembly of claim 9, wherein said lower mandrel is provided with means for centralizing position of said packer within said casing, said means for centralizing comprising a plurality of elongated members extending outwardly from an exterior surface of said lower mandrel below said at least one sealing member.

12. The assembly of claim 9, wherein said upper mandrel has an inner annular groove, and a split ratchet ring is fitted into the groove, said ring threadably engaging an exterior wall of said lower mandrel to prevent said at least one sealing member from moving from its expanded position.

13. The assembly of claim 9, wherein said band carries a plurality of guide springs to allow a temporary retaining of said band while the body of the liner hanger is rotated to release said pin and allow said pin to slide within said slot.

14. The assembly of claim 9, wherein a plurality of wedge-shaped friction members are secured on an exterior surface of said body of the liner hanger about said band, said friction members engaging the inner wall of said casing with a friction force which increases as the packer is forced downwardly.

15. The assembly of claim 1, wherein said setting tool comprises:

an elongated tubular mandrel;

an upper sub detachably securely connected to one end of said mandrel;

a lower sub securely detachably connected to an opposite end of said mandrel; and a setting collar mounted in a circumferential relationship about at least a portion of said mandrel between said upper sub and said lower sub, said setting collar contacting a top edge of said upper mandrel when the packer assembly is moved, with a predetermined force, downwardly.

16. The assembly of claim 15, wherein said setting collar is provided with at least one J-shaped slot adapted to receive a guide pin in a sliding engagement therein.

17. The assembly of claim 16, wherein said setting tool further comprises a tubular running nut member mounted in a circumferential relationship about a part of said tubular mandrel adjacent said setting collar, said running nut member carrying said guide pin.

18. The assembly of claim 17, wherein said running nut member comprises an enlarged diameter portion provided with external threads for engaging corresponding threads of said lower mandrel.

19. The assembly of claims 15, wherein said setting tool further comprises an elongated sub detachably connectable to said lower sub, said tubular sub carrying at least one flexible resilient cup which engages an interior wall of said lower mandrel below said at least one sealing member.

* * * * *